United States Patent [19]

Kiernan et al.

[11] 3,935,046

[45] Jan. 27, 1976

[54] NON-WOVEN FABRICS

[75] Inventors: Geoffrey Poulter Kiernan, Cockermouth; William Tinkler, Workington, both of England

[73] Assignee: Imperial Chemical Industries Limited, London, England

[22] Filed: Nov. 6, 1972

[21] Appl. No.: 303,958

[52] U.S. Cl. ..... 156/148; 28/72 NW; 28/72.2 R; 156/177; 428/282; 428/288; 428/300

[51] Int. Cl.[2] ..... D04H 1/48

[58] Field of Search ..... 156/148, 62.2, 62.6, 181, 156/306, 296, 305, 161, 163, 164, 166, 176, 156/180; 28/72.2 R, 72 NW, 73, 72 FF, 72.1; 428/282, 288, 300

[56] References Cited

UNITED STATES PATENTS

| | | | |
|---|---|---|---|
| 3,112,552 | 12/1963 | Smith | 156/148 |
| 3,428,506 | 2/1969 | Johnstone | 28/72.2 R |
| 3,506,530 | 4/1970 | Crosby | 28/72.2 R |
| 3,639,195 | 2/1972 | Sanders | 156/148 |
| 3,649,429 | 3/1972 | Hughes | 156/148 |
| 3,684,601 | 8/1972 | Hayward, Jr. | 156/148 |
| 3,705,064 | 12/1972 | Lochner | 28/72.2 R |

FOREIGN PATENTS OR APPLICATIONS

| | | | |
|---|---|---|---|
| 1,175,530 | 12/1969 | United Kingdom | 28/72.2 R |
| 1,164,622 | 9/1969 | United Kingdom | 28/72.2 R |

*Primary Examiner*—Douglas J. Drummond
*Assistant Examiner*—F. Frisenoa, Jr.
*Attorney, Agent, or Firm*—Cushman, Darby & Cushman

[57] ABSTRACT

A process for producing a non-woven fabric having a textured surface, comprising forming a web of fibres at least a proportion of which are potentially adhesive, superimposing said web on a scrim fabric and passing said web and scrim through a needle loom containing coarse gauge needles whereby fibres of said web are needle punched through the scrim, needle punching fibres of a second web with coarse gauge needles on to the scrim side of the web-scrim assembly, subsequently needle punching the assembly with fine gauge needles from both sides, and finally treating the assembly so as to form bonds between contiguous fibres.

12 Claims, 4 Drawing Figures

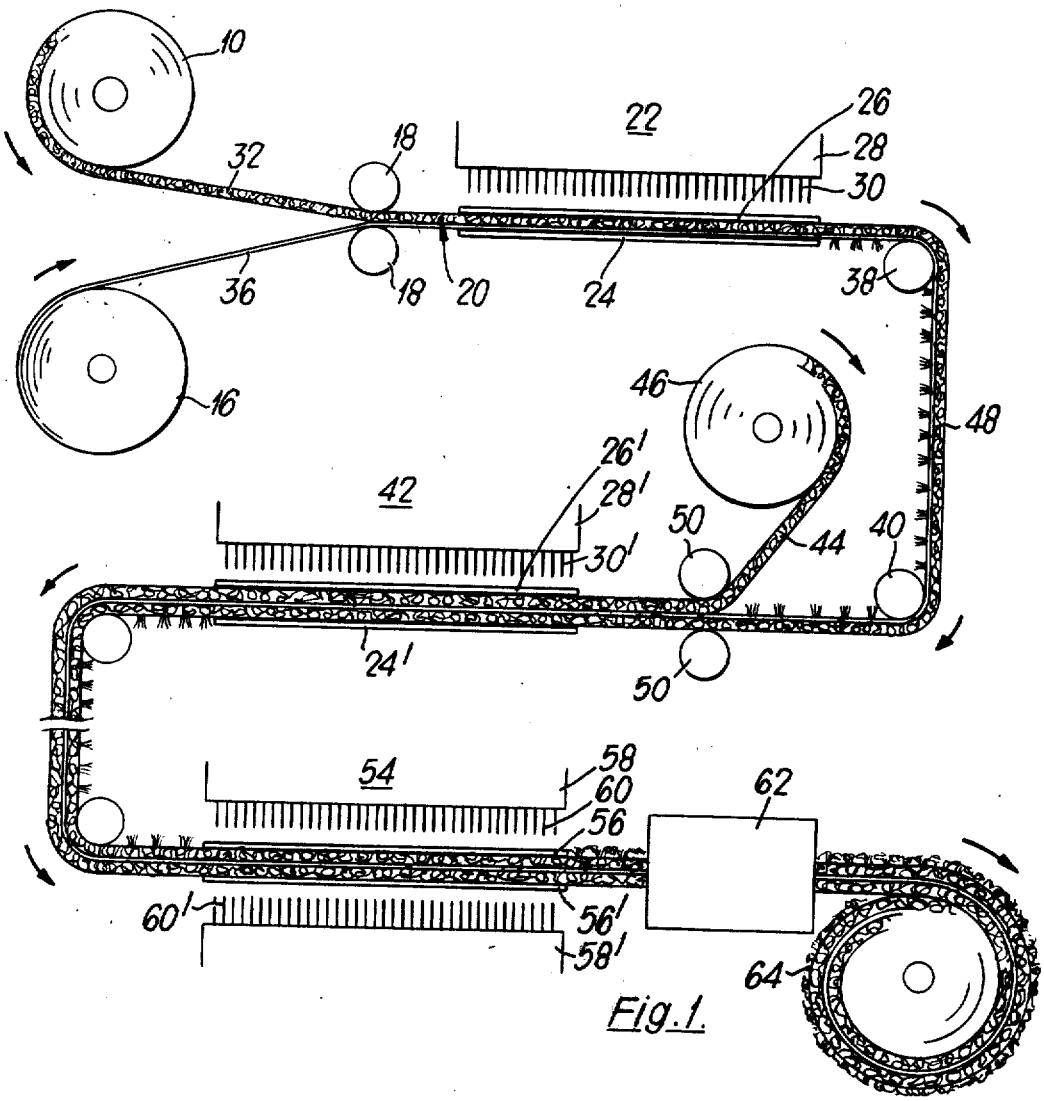
Fig. 1.
Fig. 2.
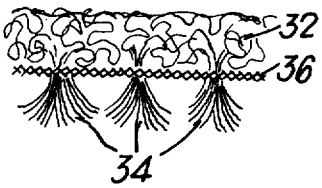
Fig. 3.
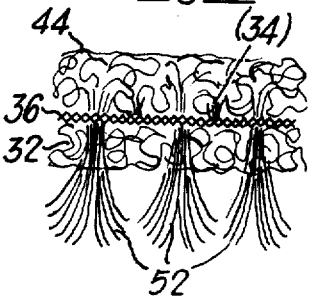
Fig. 4.
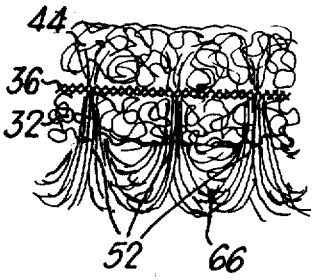

NON-WOVEN FABRICS

The invention relates to improvements in the manufacture of non-woven fabrics containing at least a proportion of potentially adhesive fibres, and particularly that class of non-woven fabrics containing at least a proportion of bicomponent fibres and strengthened and stabilised by inter-fibre bonds derived from one component of those bicomponent fibres. By potentially adhesive fibres we mean fibres which can be, or have been, rendered adhesive by a treatment which leaves other non-activatable fibres substantially unaffected.

It has already been proposed to make non-woven fabrics having a textured surface, that is, having tufted or pile-like surface by forming a mat or web of fibres passing the web or mat through a needle loom, in which some fibres of the web are reoriented to lie substantially perpendicular to the web and protrude beyond the surface thereof and subsequently treating the fibrous assembly to bond together the fibres in order to strengthen and stabilise the structure as a whole. In some cases the stability of the structure has been increased by the inclusion of a woven scrim fabric within the web of fibres. The surface texture of the non-woven fabric depends to a great extent on the gauge of the needles with which the web is punched and upon the number of needle punches per unit area. Thus, if coarse gauge needles are used, large tufts of fibres spaced apart from each other will be produced, and if fine gauge needles are used, small tufts, again spaced apart, will be produced. Multiple-passes through the needle loom or a high density of needle penetrations per unit area increases the tuft density, but as many as four passes with coarse gauge needles and up to eight passes with fine gauge needles are found to be necessary to produce an evenly tufted surface. Even after multiple passes of the non-woven material through the needle loom the appearance of the surface produced with fine gauge needles differs from the surface produced with coarse gauge needles, the latter having a grainy appearance arising from the relatively large size of the tufts.

It is also known that the physical characteristics of the non-woven fabric are affected by the depth to which the needles penetrate through the web. If needles are arranged to penetrate only a small distance through the web then the small tuft height provides the surface with good resistance to abrasion, but since the fibres contained in the tufts constitute a small proportion of the total number of fibres than those there is little protection for the fibres in the web and consequently such latter fibres are prone to become loosened and pilling occurs.

This effect is particularly noticed with fine gauge needling of a non-woven web because at most a very small proportion of fibres can be carried by the fine gauge needles into the tufts.

We have now found that a non-woven fabric having an attractive appearance, good abrasion resistance and a high resistance to pilling can be produced without the need for the previously necessary high number of passes through the needle loom, by a first needling with coarse gauge needles and a subsequent needling with fine gauge needles.

Thus, according to the invention there is provided a process for producing a non-woven fabric having a textured surface, comprising forming a web of fibres at least a proportion of which are potentially adhesive superimposing said web on a scrim fabric and passing said web and scrim through a needle loom containing coarse gauge needles whereby fibres of said web are needle punched through the scrim, needle punching fibres of a second web with coarse gauge needles on to the scrim side of the web scrim assembly, subsequently needle punching the assembly with fine gauge needles from both sides, and finally treating the assembly so as to form bonds between contiguous fibres.

The gauges of needles may be defined as coarse up to 25 blade gauge and as fine 25 blade gauge and above. Preferably the difference in gauge between fine and coarse needles is at least 10.

The needling with coarse gauge needles serves to unite the web with the scrim or with the web scrim combination as the case may be and after the coarse needling stage there is produced an assembly having large tufts of fibres on the surface of the first web, the fibres of the tufts being derived from the second web and passing through the scrim and first web. This product, even if the fibres are bonded together, has a marked tendency to pill. The subsequent needle punching of both surfaces using fine gauge needles, however, intermingles the fibres and modifies the surface appearance by reducing the pile height and merging the large individual tufts to give a smooth textured surface having a pile-like appearance. After bonding the fabric has a good resistance to abrasion and resistance to pilling.

It is necessary that the webs used in the process of the invention contain at least 5%, preferably 25%, potentially adhesive fibres. Such fibres, which are used in the process of the invention as bonding agents, may be any synthetic thermoplastic organic polymer, such as, for example, polyamide, polyester, polyolefin or polyacrylonitrile. These fibres may be used alone, although it is preferred that they are blended with fibres which do not become adhesive under the conditions in which the thermoplastic fibres become adhesive. The non-adhesive fibres may be natural fibres, such as wool or cotton fibres, or may be thermoplastic fibres which remain unaffected during the bonding treatment. A preferred embodiment employs multi-component fibres, having a component, occupying at least part of the surface of the fibre, that can be rendered adhesive under conditions which leaves at least one other component unaffected, either alone or in admixture with other non-activatable fibres. If desired, the component of the multi-component fibres may be arranged asymmetrically so that the fibres are able to develop crimp by a suitable treatment, which can conveniently be the bonding treatment.

The invention is further described in the accompanying drawing in which:

FIG. 1 is a representation of a process according to the invention,

FIGS. 2 and 3 are illustrative cross-sections of structures intermediate to the non-woven fabric according to the invention, and FIG. 4 is a cross-section through a sample of fabric made according to the invention.

Referring to FIG. 1, reference numeral 10 indicates a storage roll of non-woven web containing a proportion of potentially adhesive fibers and manufactured in a conventional manner, for example, by air deposition of the fibers of the like, or other well known process. A scrim material 36 is unrolled from roll 16 via take-off rolls 18 whereat the non-woven web 32, unrolling from roll 10, is superimposed upon scrim material 36.

The superimposed non-woven web and scrim material 20 is then passed to a first needle loom 22 wherein needle board 28, adapted to be reciprocated vertically by suitable means (not shown) such as a crankshaft, carrying a plurality of coarse gauge barbed needles 30 moves up and down. As is conventional, the barbed needles 30 are first passed or driven through aligned holes in a strip or plate 26, through the non-woven web and scrim 20 and through aligned holes in bed plate 24, and are then withdrawn. During passage of the barbed needles through the non-woven web, the barbs engage certain of the fibers thereof and carry them through the scrim material. When the needles are withdrawn the fibers are released from the barbs and remain as tufts of fibers on the side of the scrim material remote from the non-woven web from which they are derived.

FIG. 2 is an illustration of the cross-sectional structure of the non-woven assembly 48 emerging from the needle loom 22. Tufts of fibers 34 extend from non-woven web 32 through scrim material 36.

On emerging from needle loom 22, the assembly 48 is led by guide rolls 38 and 40 to a second needle loom 42. Before entering loom 42, however, a second non-woven web 44 unrolled from storage roll 46 is laid on the scrim side of the non-woven assembly 48 at feed rolls 50. Second needle loom 42 is similar in structure and operation to needle loom 22 and comprises the conventional bed plate 24', stripper plate 26', needle bore 28' containing a plurality of coarse gauge needles 30'. On emerging from needle loom 42 the non-woven composite has the structure illustrated in FIG. 3. Tufts 52 extend from second non-woven web 44 through scrim 36 and first non-woven web 32 and appear on the surface of second non-woven web 32 as large tufts, each containing a multiplicity of fibers.

The assembly is next passed to needle loom 54 which is a double acting needle loom whereby needles can penetrate the non-woven structure from both sides simultaneously. Needle loom 54 consists of plates 56 and 56', reciprocating needle bores 58, 58' containing a plurality of fine gauge needles 60, 60'.

The barbed needles 60' engage with certain of the fibers in non-woven webs 44 and 32 and carry these beyond the surface of web 32 where they entangle and intermingle with the fibers of tufts 52.

On emerging from needle loom 54 the non-woven assembly is passed through a bonding chamber 62 wherein the potentially adhesive fibers are treated so as to activate their adhesiveness and to cause bonds to form between contiguous fibers. The product may then be wound up on roll 64.

Fibers of tufts 52 are entangled and intermingle with the fibers of adjacent tufts 52 as illustrated at 66 and with fibers from non-woven webs 32 and 44.

In the production of such fabrics by the preferred method a web of fibre composed of 10–90% bicomponent fibre and 90–10% non-bicomponent fibres may advantageously be used.

The weight of the web on each side of the scrim can range from 15 to 250 grams per square meter. A typical range of the punch density of the first two needle punches is between 5 and 100 punches per $cm^2$, with similar figures for the second two punches, and the needle penetrations may be between 0.9 and 1.6 cm. The type of needles which may be used can be regular barb, close barb or bunch barb, the penetration and punch density being altered for each type of needle being used.

The invention is further illustrated by the following example which in no way limits the scope thereof.

EXAMPLE 6 denier bicomponent fibres having a core-sheath configuration, the core being composed of nylon 66 and the sheath being composed of nylon 6, in a volume ratio of 50:50 were cut to a length of 5 cm.

These fibres were blended in equal proportions with 6 denier, 5 cm long nylon 66 staple fibres and a random web weighing 85 grams per square meter was formed from the blend on an air-laying machine. This web was needle punched on to a nylon scrim (containing 8 warp yarns and 6 weft yarns per inch) at a punch density of 47 punches per sq cm. using 15 × 19 × 3½ regular barb needles with a needle penetration of 1.6 cm. After the needling had been completed, the combined web and scrim was turned over and a second identical web was needled on to the other side of the scrim in an identical manner. This product was then turned over on to the first side and needled at a similar punch density with needles designated 15 × 18 × 32 × 3½ regular barb with a penetration of 1.25 cm. The product was then turned back to the second side and punched in a similar manner. The product was finally heated in a recirculating oven containing 85% steam, 15% air at a temperature of about 230°C. The resultant fabric was smooth-surfaced with a high resistance to abrasion and pilling, and was suitable for use as an upholstery or finishing fabric.

What we claim is:

1. A process for producing a non-woven fabric having a textured surface, comprising:

forming a first non-woven web of fibers at least 5% by weight of which are potentially adhesive, superimposing said first web on a scrim fabric, and passing said first web and scrim through a needle loom containing coarse gauge needles whereby fibers of said first web are needle punched through the scrim, needle punching fibers of a second non-woven web with coarse gauge needles on to the scrim side of the web-scrim assembly to carry fibers from said second web through said scrim and said first web to form large tufts on the surface of said first web, subsequently needle punching the assembly with fine gauge needles from both sides thereby forming intermingled tufts of fibers of said first and second non-woven web on the surface of said first non-woven web, and finally treating the assembly to render adhesive the potentially adhesive fibers so as to form bonds between continguous fibers.

2. A process according to claim 1, wherein the difference in gauge between coarse and fine needles is at least 10.

3. A process according to claim 2, wherein the web is needled with coarse needles to a penetration density between 5 and 100 punches per $cm^2$.

4. A process according to claim 3, wherein the first and second webs weigh between 15 and 250 grams per square meter.

5. A process according to claim 4, wherein the needle penetration is between 0.9 cm and 1.6 cm.

6. A process as claimed in claim 5, wherein the potentially adhesive fibres are bicomponent fibres in which at least a portion of the surface comprises a potentially adhesive component.

7. A process as claimed in claim 6, wherein the components of said bicomponent fibres are arranged in a core-sheath configuration.

8. A process as claimed in claim 6, wherein the components of said bicomponent fibres are arranged in a side-by-side configuration.

9. A process as claimed in claim 6, including the steps of arranging the components of said bicomponent fibers asymmetrically relative to one another in at least one of the non-woven webs and developing crimp in the bicomponent fibers during the step of treating the assembly to render adhesive the potentially adhesive fibers.

10. A process as claimed in claim 9, wherein the bicomponent fibres develop crimp during the bonding treatment.

11. A process as in claim 1 wherein the final treatment is a heat-treatment.

12. A process for producing a non-woven fabric having a textured surface, comprising the steps of:

a. superimposing a blended web of fibers on a nylon scrim containing 8 warp yarns and 6 weft yarns per inch, said web of fibers being of 6 denier bicomponent having a core composed of nylon 66 and a sheath composed of nylon 6 blended with 6 denier nylon 66 staple fibers;

b. passing said web and scrim through a needle loom containing 15 × 19 × 3½ regular barb needles arranged to penetrate 1.6 cm through the web wherein said web and scrim are needled to a punch density of 47 punches per square centimeter to form a combined web and scrim;

c. turning over said combined web and scrim and applying an identical web on the scrim side thereof, and passing the same through a needle loom containing 15 × 19 × 3½ regular barb needles which make first contact with a surface of said identical web, wherein said identical web and said web and scrim are needled to a punch density of 47 punches per square centimeter, said needles penetrating 1.6 cm through said identical web and said web and scrim to thereby carry fibers from said identical web through said web and scrim to form large tufts on the surface of said first web;

d. turning over for a second time said combination and passing said combination on both sides thereof through a needle loom containing 15 × 18 × 32 × 3½ regular barb needles with a penetration of 1.25 cm and a punch density of approximately 47 punches per square centimeter; and e. heating said combination in a recirculating oven containing 85% steam and 15% air to a temperature of approximately 230°C.

* * * * *